United States Patent [19]

Schreiber

[11] 4,267,255

[45] May 12, 1981

[54] NOVEL PHOTOGRAPHIC PROCESSING COMPOSITION

[75] Inventor: Karl J. Schreiber, Waban, Mass.

[73] Assignee: Polaroid Corporation, Cambridge, Mass.

[21] Appl. No.: 102,670

[22] Filed: Dec. 12, 1979

Related U.S. Application Data

[63] Continuation-in-part of Ser. No. 32,887, Apr. 24, 1979, abandoned.

[51] Int. Cl.[3] ..... G03C 5/54; G03C 1/48; G03C 5/30; G03C 1/02

[52] U.S. Cl. ..... 430/245; 430/244; 430/246; 430/247; 430/249; 430/251; 430/444; 430/456; 430/486; 430/493; 430/637

[58] Field of Search ..... 430/244, 246, 249, 251, 430/444, 456, 493, 637, 486, 245, 247

[56] References Cited

U.S. PATENT DOCUMENTS

| | | | |
|---|---|---|---|
| 2,531,832 | 11/1950 | Stanton | 430/444 |
| 2,533,990 | 12/1950 | Blake | 430/444 |
| 2,857,274 | 10/1958 | Land et al. | 430/251 |
| 3,615,440 | 10/1971 | Bloom et al. | 430/249 |
| 3,622,330 | 11/1971 | Valiaveedan | 430/493 |
| 3,679,411 | 7/1972 | Stephens | 430/244 |
| 3,754,924 | 8/1973 | DeGeest et al. | 430/493 |
| 3,837,854 | 9/1974 | Waxman et al. | 430/251 |
| 4,014,699 | 5/1977 | Schellenberg | 430/493 |
| 4,038,075 | 7/1977 | Pollet et al. | 430/444 |
| 4,126,459 | 11/1978 | Greenwald | 430/251 |
| 4,168,166 | 9/1979 | Land | 430/251 |

FOREIGN PATENT DOCUMENTS

| | | | |
|---|---|---|---|
| 577327 | 6/1959 | Canada | 568/615 |

*Primary Examiner*—Richard L. Schilling
*Attorney, Agent, or Firm*—Philip G. Kiely

[57] ABSTRACT

A processing composition adapted for use in a silver diffusion transfer film unit which comprises an aqueous alkaline solution, a silver halide developing agent and a surfactant comprising a hydrophobe and a polyethylene oxide portion containing an average of about 5–25 repeating units of ethylene oxide per hydrophobe.

24 Claims, No Drawings

NOVEL PHOTOGRAPHIC PROCESSING COMPOSITION

CROSS REFERENCE TO OTHER APPLICATIONS

This application is a continuation-in-part of copending application Ser. No. 032,887, filed Apr. 24, 1979, now abandoned.

BACKGROUND OF THE INVENTION

Procedures for preparing photographic images in silver by diffusion transfer principles are well known in the art. For the formation of the positive silver images, a photosensitive silver halide emulsion is exposed and contacted with a processing composition containing a silver halide solvent so that a latent image contained in the exposed emulsion is developed and, almost concurrently therewith, a soluble silver complex is obtained by reaction of the silver halide solvent with the unexposed and undeveloped silver halide of said emulsion.

This soluble silver complex is, at least in part, transported in the direction of a print-receiving element and the silver thereof is largely precipitated in the silver precipitating element to form a positive image thereon. Preferably, the photosensitive silver halide emulsion is developed with a processing composition which is spread between the photosensitive element comprising the silver halide emulsion and a print-receiving element comprising a suitable silver-precipitating layer. Procedures of this description are disclosed, for example in U.S. Pat. No. 2,543,181 issued to Edwin H. Land. See, also, Edwin H. Land, One Step Photography, Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed or positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

Such film assemblies as those disclosed in the above indicated patents find particular utility in cine film systems such as, for example, the system described in U.S. Pat. No. 3,615,127 which includes a compact film cassette or container adapted to allow exposure of a film assemblage retained therein, subsequent processing of the film unit to provide the desired image record and projection of the resultant image record. Thus, the film assemblage may be exposed, processed, and projected without transferring the film from its original container. The cine film system of U.S. Pat. No. 3,615,127 includes a film processing station whereupon the exposed film strip is transported from a first storage reel, past an applicator where a moist processing composition adapted to develop to a visible condition images recorded on the film is applied and thence to a second storage reel.

The additive diffusion transfer film units disclosed above are processed by an aqueous alkaline processing composition adapted to effect development of the latent image in the silver halide emulsion and provide a positive silver image thereby, and which preferably includes a silver halide developing agent and a silver halide solvent.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1975, to Edwin H. Land or a pseudo uracil, such as the 4,6-dihydroxypyrimidines as taught in U.S. Pat. No. 4,126,459, issued Nov. 21, 1978.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, by an alkaline material, such as sodium, potassium and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho- positions with respect to each other, such as hydroquinone, tert-butyl hydroquinone, toluhydroquinone, p-aminophenol, 2,6-dimethyl-4-aminophenol, 2,4,6-triaminophenol, etc. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha$, $\beta$-enediols as disclosed in U.S. Pat. No. 3,730,716 issued to Edwin H. Land, Stanley M. Bloom and Leonard C. Farney on May 1, 1973.

U.S. Pat. No. 3,782,263 discloses a motion picture film which carries a pair of elongated rail-like protuberances which are carried on the opposite side of the film strip from the photosensitive silver halide emulsion. These protuberances preferably project above the surface of the film unit a distance exceeding the height of deposited fluid processing composition. When the motion picture film is rewound subsequent to the application of the processing composition, the processing composition is not in a completely dried state and the above-described protuberances provide means for spacing adjacent turns of the film strip and thus prevent adhesion of such turns and subsequent damage to the film upon unwinding By means of the present invention, it has now been found that the problem of film adhesion can be alleviated or eliminated entirely without the use of the above-mentioned rail-like protuberances.

SUMMARY OF THE INVENTION

The present invention is directed to a novel photographic processing composition for use in processing a silver diffusion transfer film unit wherein said processing composition includes an aqueous alkaline solution, a silver halide developing agent and a surfactant comprising a hydrophobe and a polyethylene oxide portion containing an average of about 5–25 repeating units of ethylene oxide per hydrophobe. Preferably, the film unit is in the form of an elongated film strip.

The processing composition of the present invention is particularly suitable for processing additive color diffusion transfer motion picture film units.

By means of the present invention, a silver diffusion transfer film unit may be employed without the above-described rail-like protuberances and rolled and unrolled upon itself while wet with processing composition without blocking or delamination.

It should be understood, however, that the processing composition is not limited to use in motion picture film but may be employed in any photographic application wherever release properties are desired.

The surfactant employed in the present invention is soluble in the alkaline processing composition. This solubility is provided by the ethylene oxide portion of the compound and results in a homogeneous processing composition. By using a surfactant with the indicated ethylene oxide content, substantially no thickening properties are imparted to the processing composition. Any required thickening of the processing composition is provided by the use of a polymeric thickening agent, such as hydroxyethyl cellulose or carboxymethyl cellulose and the use of the defined surfactant does not materially affect the viscosity of the processing composition.

The particular hydrophobic portion of the surfactant is not critical provided that no adverse effects are imparted to the photographic properties of the film unit. It is believed that the polyethylene oxide portion of the surfactant penetrates and wets the surface of the film unit while the hydrophobe orients on the surface of the film unit and provides parting ability from the surface without delamination or blocking.

Surfactants suitable for use in the present invention are known to the art and are commercially available. In characterizing the compound it will be seen that the ethylene oxide component is specified at an average of about 5–25 units per hydrophobe. When the hydrophobe is a silicone an average of about 6–7 units of ethylene oxide are preferred and when the hydrophobe is a fluorocarbon an average of about 8–14 ethylene oxide units are preferred.

The quantity most effective for a given processing composition can be readily determined by a routine scoping series. Preferably, the surfactant is employed at a level of about 0.25 to 5.0% by weight of active solids based on the weight of the processing composition. Of course, amounts greater than 5.0% may also be employed with the only limitation on the upper level being the adverse sensitometric effects which may result from excessive amounts of the surfactant.

The following non-limiting examples illustrate the novel processing composition of the present invention.

EXAMPLE 1

A film unit was prepared comprising a transparent polyester film base carrying on one surface an additive color screen of approximately 1500 triplets per inch of red, blue and green filter screen elements in repetitive side-by-side relationship; a 328 mgs/ft$^2$ polyvinylidine chloride/polyvinyl formal protective overcoat layer; a nucleating layer comprising palladium nuclei at a coverage of 0.15 mgs/ft$^2$ Pd and 0.15 mgs/ft$^2$ gelatin and 0.8 mgs/ft$^2$ hydroxyethyl cellulose; an interlayer formed by coating 1.9 mgs/ft$^2$ gelatin and 2.3 mgs/ft$^2$ acetic acid and 0.19 mgs/ft$^2$ octylphenoxy polyethoxy ethanol surfactant; a hardened gelatino silver idobromo emulsion (a 50–50 blend of 0.59$\mu$ and 0.72$\mu$ mean diameter grains) coated at a coverage of about 69.4 mgs/ft$^2$ of gelatin and about 84 mgs/ft$^2$ of silver with about 3.25 mgs/ft$^2$ propylene glycol alginate and about 0.55 mgs/ft$^2$ of nonyl phenol polyglycol ether (containing 9.5 moles of ethylene oxide) and 18.9 mgs/ft$^2$ of a carboxylated styrene/butadiene copolymer latex (Dow 620, Dow Chemical Company, Midland, Michigan;) panchromatically sensitized with 5,5'-dimethyl-9-ethyl-3,3'-bis-(3 sulfopropyl) thiacarbocyanine triethylammonium salt (0.53 mg/gAg); 5,5'-diphenyl-9-ethyl-3,3'-bis-(4-sulfobutyl) oxacarbocyanine (0.75 mg/gAg); anhydro-5,6-dichloro-1,3-diethyl-3'-(4" sulfobutyl)-benzimidazolothiacarbocyanine hydroxide (0.7 mg/gAg); and 3-(3-sulfopropyl)-3'-ethyl-4,6-benzothia-2-thiacyanine betaine (1.0 mg/gAg); red, green, green and blue sensitizers respectively; and the following antihalo top coat. The antihalo top coat referred to below is disclosed and claimed in copending application Ser. No. 383,261, filed July 27, 1973.

| Top Coat | mgs/ft$^2$ |
|---|---|
| Gelatin | 400 |
| Dow 620 (carboxylated styrene/butadiene copolymer latex Dow Chemical Co., Midland, Michigan) | 204 |
| Propylene glycol alginate | 25.7 |
| Dioctyl ester of sodium sulfosuccinate | 1.2 |
| Benzimidazole-2-thiol gold $Au^{+1}$ complex | 5 (as gold) |
| Daxad-11 (polymerized sodium salts of alkyl naphthalene sulfonic acid) Manufactured by W. R. Grace & Co. Cambridge, MA | 0.38 |
| Pyridinium bis-1,5 (1,3-diethyl-2-thiol-5-barbituric acid) pentamethine oxanol | 5.6 |
| 4-(2-chloro-4-dimethylamino benzaldehyde)-1-(p-phenyl carboxylic acid)-3-methyl pyrazolone-5 | 7 |

| PROCESSING COMPOSITION | Weight % |
|---|---|
| Sodium hydroxide | 8.43 |
| Hydroxyethyl cellulose (Sold by Hercules, Inc., Wilmington, Delaware under the tradename Natrasol 250 H H) | 0.64 |
| Tetramethyl reductic acid | 7.04 |
| Potassium bromide | 0.62 |
| 2-methylthiomethyl-4,6-dihydroxypyrimidine | 7.04 |
| 4-aminopyrazolo-[3,4d]-pyrimidine | 0.02 |
| N-benzyl-$\alpha$-picolinium bromide (50% solution) | 3.52 |
| Sodium tetraborate . $10H_2O$ | 3.31 |
| Glycerin | 1.68 |
| p-isononylphenoxypolyglycidol (containing about 10 glycidol units) | 0.50 |
| Sodium sulfite | 0.82 |
| Water | 66.4 |

Film units described above were formed into elongated strips and loaded into a film cassette of the type described in the above-mentioned U.S. Pat. No.

3,615,127, exposed in an automatic camera at a nominal ASA 16 at 3400° K. and processed in the cassette with the above designated processing composition containing 0, and 1.25 to 5.0 percent by weight of the surfactant $CF_3(CF_2)_m(CH_2)_2—O—(CH_2CH_2O)_{11}H$ wherein said surfactant is a mixture with m being 5, 7 and 9 based on the weight of the processing composition. The identified surfactant is commercially available from E. I. duPont de Nemours, & Co., Wilmington, Delaware.

The processed film strips were projected 3 times. Delamination and blocking of the film strips containing 0% surfactant was observed after 2 or 3 projections. Film strips containing the surfactant showed no signs of blocking at any level.

Other film units described above were exposed, processed and projected once, and then placed in a 100° F., 80% relative humidity chamber for 72 hours and then allowed to equilibrate for 2 hours at room temperature. The film strips were then projected. The film strip containing 0% surfactant exhibited massive delamination. Delamination was not evident in film units processed with the processing composition of the present invention. Similar advantageous results were obtained on film units described above containing the defined surfactant which were stored in a 120° F. oven instead of the humidity chamber for three days.

The following table shows additional surfactants within the scope of the present invention employed in processing compositions as described above. Film units processed with processing compositions containing the designated surfactants were projected 5 times without any delamination or blocking. Similar satisfactory results were also observed on film units subjected to accelerated aging conditions.

TABLE

| Surfactant Hydrophobe | Units of ethylene oxide per hydrophobe | Concentration (by weight, active solids based on weight of processing composition | Source |
|---|---|---|---|
| Linear alcohol | 5 | 5% | Sold by Union Carbide Corp., N.Y., N.Y. under the tradename TERGITOL 15-S-5 |
| Trimethyl nonanol | 10 | 4.5% | Sold by Union Carbide Corp., N.Y., N.Y. under the tradename TERGITOL TMN-10 |
| Lauryl alcohol | 12 | 5% | Sold by Union Carbide Corp., N.Y., N.Y. under the tradename TRYCOL LAL-12 |
| Oleyl alcohol | 23 | 5% | Sold by Union Carbide Corp., N.Y., N.Y. under the tradename TRYCOL OAL-23 |
| Tridecyl alcohol | 12 | 5% | Sold by Union Carbide Corp., N.Y., N.Y. under the tradename TRYCOL TDA-12 |
| $C_{16}—C_{18}$ tallow amine | 11 | 2.0% | Sold by E. I. duPont de Nemours, & Co., Wilmington, Delaware under the tradename ALKANOL A-CN |
| Oleyl phosphate | 10 | 3.5% | Sold by HODAG Chemical Corp., |

TABLE-continued

| Surfactant Hydrophobe | Units of ethylene oxide per hydrophobe | Concentration (by weight, active solids based on weight of processing composition | Source |
|---|---|---|---|
| ester | | | Skokie, Ill. under the tradename HODAG PE 1810 |
| Organo silicone | 7 | 2.5% | Sold by Union Carbide Corp., N.Y., N.Y. under the tradename L-7604 |

It should also be noted that a 100% polyethylene oxide polymer failed to produce the desired results, i.e., delamination was observed in the film units processed with a processing composition containing this polymer.

The support employed in the present invention is not critical. The support of film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol and terephthalic acid; polymer cellulose derivatives such as cellulose acetate, triacetate, nitrate, propionate, butrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas of filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelengths ranges, i.e., red, green and blue. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

What is claimed is:

1. A photographic processing composition adapted for use with a silver diffusion transfer film unit which comprises an aqueous alkaline solution, a silver halide developing agent and surfactant comprising a hydrophobe and a polyethylene oxide portion containing an average of about 5–25 ethylene oxide units per hydrophobe wherein said hydrophobe is a fluorinated hydrocarbon or an organo silicone.

2. The composition of claim 1 wherein said film unit comprises an elongated strip adapted to be wound upon itself.

3. The composition of claim 1 wherein said surfactant is present at a level of about 0.25 to 5.0% by weight of active material based on the weight of the processing composition.

4. The composition of claim 3 wherein said surfactant is present at a level of about 0.5% by weight based on the weight of said composition.

5. The composition of claim 1 wherein said surfactant contains an average of about 11 units of ethylene oxide units per hydrophobe.

6. The composition of claim 1 wherein said silver halide developing agent is tetramethyl reductic acid.

7. The composition of claim 1 which includes a silver halide solvent.

8. The composition of claim 7 wherein said silver halide solvent is 2-methylthiomethyl-4,6-dihydroxypyrimidine.

9. The composition of claim 1 which includes a polymeric thickening agent.

10. The composition of claim 1 wherein said film unit is an additive color diffusion transfer film unit.

11. A photographic processing composition adapted for use with an additive color diffusion transfer film unit which comprises an aqueous sodium hydroxide solution, tetramethyl reductic acid, 2-methylthiomethyl-4,6-dihydroxy-pyrimidine, hydroxyethyl cellulose and a nonionic surfactant of the formula $$CF_3(CF_2)_m(CH_2)_2\text{—}O(CH_2CH_2O)_nH$$

wherein said surfactant is a mixture and n averages about 11 and m is 5, 7 and 9.

12. The method which comprises contacting an exposed silver diffusion transfer film unit which comprises a support, carrying on one surface, a layer comprising silver-precipitating nuclei, and a photosensitive silver halide layer; with a photographic processing composition comprising an aqueous alkaline solution, a silver halide developing agent and a surfactant comprising a hydrophobe and a polyethylene oxide portion containing an average of about 5–25 units of ethylene oxide per hydrophobe wherein said hydrophobe is a fluorinated hydrocarbon or an organo silicone.

13. The method of claim 12 wherein said film unit comprises an elongated strip adapted to be wound upon itself and which includes the step of winding said film unit upon itself.

14. The method of claim 12 wherein said surfactant is present at a level of about 0.25 to 5.0% active material by weight based on the weight of said processing composition.

15. The method of claim 14 wherein said surfactant is present at a level of about 0.5% by weight.

16. The method of claim 12 wherein said surfactant contains an average of about 11 units of ethylene oxide per hydrophobe.

17. The method of claim 12 wherein said developing agent is tetramethyl reductic acid.

18. The method of claim 12 wherein said processing composition includes a silver halide solvent.

19. The method of claim 18 wherein said silver halide solvent is 2-methylthiomethyl-4,6-dihydroxypyrimidine.

20. The method of claim 12 wherein said film unit includes an additive color screen.

21. The method of claim 12 wherein said silver precipitating nuclei are noble metal nuclei.

22. The method of claim 21 wherein said noble metal nuclei are palladium nuclei.

23. The method of claim 12 wherein said processing composition includes a polymeric thickener.

24. The method of claim 23 wherein said polymeric thickener is hydroxyethyl cellulose.

* * * * *